US012660917B2

(12) United States Patent
Lin et al.

(10) Patent No.: US 12,660,917 B2
(45) Date of Patent: Jun. 23, 2026

(54) SLIDING RAIL DEVICE

(71) Applicant: FOSITEK CORPORATION, New Taipei City (TW)

(72) Inventors: Kai-Hung Lin, New Taipei City (TW); Kuan-Wei Chen, New Taipei City (TW)

(73) Assignee: FOSITEK CORPORATION, New Taipei City (TW)

( * ) Notice: Subject to any disclaimer, the term of this patent is extended or adjusted under 35 U.S.C. 154(b) by 143 days.

(21) Appl. No.: 18/908,354

(22) Filed: Oct. 7, 2024

(65) Prior Publication Data

US 2026/0007230 A1 Jan. 8, 2026

(30) Foreign Application Priority Data

Jul. 5, 2024 (TW) ..... 113125312

(51) Int. Cl.
*A47B 57/00* (2006.01)
*A47B 57/58* (2006.01)

(52) U.S. Cl.
CPC .... *A47B 57/585* (2013.01); *A47B 2210/0018* (2013.01)

(58) Field of Classification Search
CPC ..... A47B 57/585; A47B 2210/0018; A47B 88/50; A47B 88/45; A47B 2210/0016; A47B 2210/0086; A47B 2088/4235; A47B 2097/008; H05K 7/1489; E05B 65/462; E05B 65/463; E05B 65/464
USPC ..... 312/294, 216, 217, 221, 333, 334.44, 312/319.1; 248/429, 560
See application file for complete search history.

(56) References Cited

U.S. PATENT DOCUMENTS 2,882,112 A * 4/1959 Jarvi ..... E05B 65/462 312/333
4,936,640 A * 6/1990 Pratzer ..... E05B 65/464 312/221
6,722,749 B1 * 4/2004 Pagac ..... E05B 65/463 312/221

(Continued)

FOREIGN PATENT DOCUMENTS

CN 1160010 C * 8/2004
CN 102238841 A * 11/2011 ..... H05K 7/1489

(Continued)

*Primary Examiner* — Janet M Wilkens
(74) *Attorney, Agent, or Firm* — Birch, Stewart, Kolasch & Birch, LLP

(57) ABSTRACT

A sliding rail device includes an exterior frame, an outer rail, an intermediate rail, and a blocking mechanism that has a positioning member, a blocking member having a blocking protrusion and a blocking groove, a linking piece sleeved on the positioning member, and a resilient member. When the intermediate rail is moved relative to the outer rail in a longitudinal direction, the positioning member is pushed by the blocking member to move downwardly along an inclined portion of the blocking groove, and is consequently adapted to move a linking member downwardly. When the intermediate rail is moved in a direction opposite to the longitudinal direction relative to the outer rail, the positioning member is driven by a resilient force of the resilient member, via the linking piece, to move upwardly along the inclined portion.

6 Claims, 11 Drawing Sheets

(56) References Cited

U.S. PATENT DOCUMENTS

| | | | | |
|---|---|---|---|---|
| 7,404,611 | B1 * | 7/2008 | Que | A47B 88/493 312/334.46 |
| 10,631,639 | B2 * | 4/2020 | Chen | H05K 7/1489 |
| 2011/0316397 | A1 * | 12/2011 | Sabelli | E05B 65/462 292/226 |
| 2012/0061551 | A1 * | 3/2012 | Zhang | A47B 88/57 248/560 |
| 2018/0066454 | A1 * | 3/2018 | Lu | A47B 67/04 |
| 2024/0263489 | A1 * | 8/2024 | Chen | E05B 65/463 |
| 2025/0215924 | A1 * | 7/2025 | Lin | A47B 88/57 |
| 2026/0013067 | A1 * | 1/2026 | Lin | H05K 7/1489 |

FOREIGN PATENT DOCUMENTS

| | | | | | |
|---|---|---|---|---|---|
| CN | 206596320 | U | * | 10/2017 | |
| CN | 221242123 | U | * | 7/2024 | E05B 65/463 |
| CN | 118476702 | A | * | 8/2024 | E05B 65/463 |
| EP | 3656251 | A1 | * | 5/2020 | A47B 88/443 |
| JP | H10179290 | | * | 7/1998 | |
| TW | 1751085 | | * | 12/2021 | |
| TW | 1890617 | | * | 7/2025 | |

* cited by examiner

SLIDING RAIL DEVICE

CROSS-REFERENCE TO RELATED APPLICATION

This application claims priority to Taiwanese Invention Patent Application No. 113125312, filed on Jul. 5, 2024, the entire disclosure of which is incorporated by reference herein.

FIELD

The disclosure relates to a sliding rail device, and more particularly to a sliding rail device with a blocking mechanism.

BACKGROUND

A conventional server chassis is mounted to a server rack through a conventional sliding rail device. The conventional sliding rail device includes an outer rail fixed to the server rack, an intermediate rail movably engaged with the outer rail, and an inner rail connected to the server chassis. During maintenance or change of the server chassis, the server chassis may be pulled out from the server rack through operation of the conventional sliding rail device. However, when there are several other server chassis mounted to the server rack through other conventional sliding rail devices, and when one of the server chassis is pulled out, the corresponding conventional sliding rail device is unable to prevent another server chassis from moving outwardly on its own. Hence, there is room for improvement.

SUMMARY

Therefore, an object of the disclosure is to provide a sliding rail device that can alleviate at least one of the drawbacks of the prior art.

According to the disclosure, a sliding rail device is adapted to be mounted to a server rack and connected to a linking member. The sliding rail device includes an exterior frame, an outer rail, an intermediate rail, and a blocking mechanism. The exterior frame is adapted to be fixed to the server rack, and has first and second ends, a frame surface, a fixing surface, and an exterior groove. The first end is opposite to the second end in a longitudinal direction. The fixing surface is opposite to the frame surface, extends between the first and second ends, and is adapted to face the server rack. The exterior groove extends through the frame surface and the fixing surface. The outer rail is disposed on the frame surface, and has a first outer rail surface, a second outer rail surface, and a connecting groove. The second outer rail surface is opposite to the first outer rail surface and faces the frame surface. The connecting groove extends through the first outer rail surface and the second outer rail surface, and corresponds in position to the exterior groove. The intermediate rail is movably engaged with the outer rail, and has an intermediate rail surface facing the outer rail. The blocking mechanism has a positioning member, a blocking member, a blocking strip, a linking piece, and a resilient member. The positioning member movably extends through the exterior groove and the connecting groove, and is adapted to be fixed to the linking member. The blocking member is disposed on the intermediate rail surface, and has a blocking groove and a blocking protrusion. The blocking strip is disposed on the intermediate rail surface, extends in the longitudinal direction, and abuts against the blocking member. The linking piece is sleeved on the positioning member. The resilient member is connected to the fixing surface and the linking piece. The blocking groove has a blocking portion and an inclined portion. The blocking portion extends in an up-down direction perpendicular to the longitudinal direction. The inclined portion extends from an upper end of the blocking portion towards the blocking strip, and is downwardly inclined. The blocking protrusion is disposed between the blocking portion and the inclined portion. The positioning member is engaged with and movable along the blocking groove. When the intermediate rail is moved in the longitudinal direction relative to the outer rail, the positioning member is pushed by the blocking member to move downwardly along the inclined portion against a resilient force of the resilient member, and is consequently adapted to move the linking member downwardly and adapted to drive another sliding rail device that is connected to the linking member and that is identical to the sliding rail device to move synchronously in a manner where a positioning member of the another sliding rail device is moved downwardly along a blocking portion of the another sliding rail device to be adjacent to a blocking protrusion of the another sliding rail device, so as to prevent movement of an intermediate rail of the another sliding rail device relative to an outer rail of the another sliding rail device. When the intermediate rail is moved in a direction opposite to the longitudinal direction relative to the outer rail, the positioning member is driven by the resilient force of the resilient member, via the linking piece, to move upwardly along the inclined portion.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
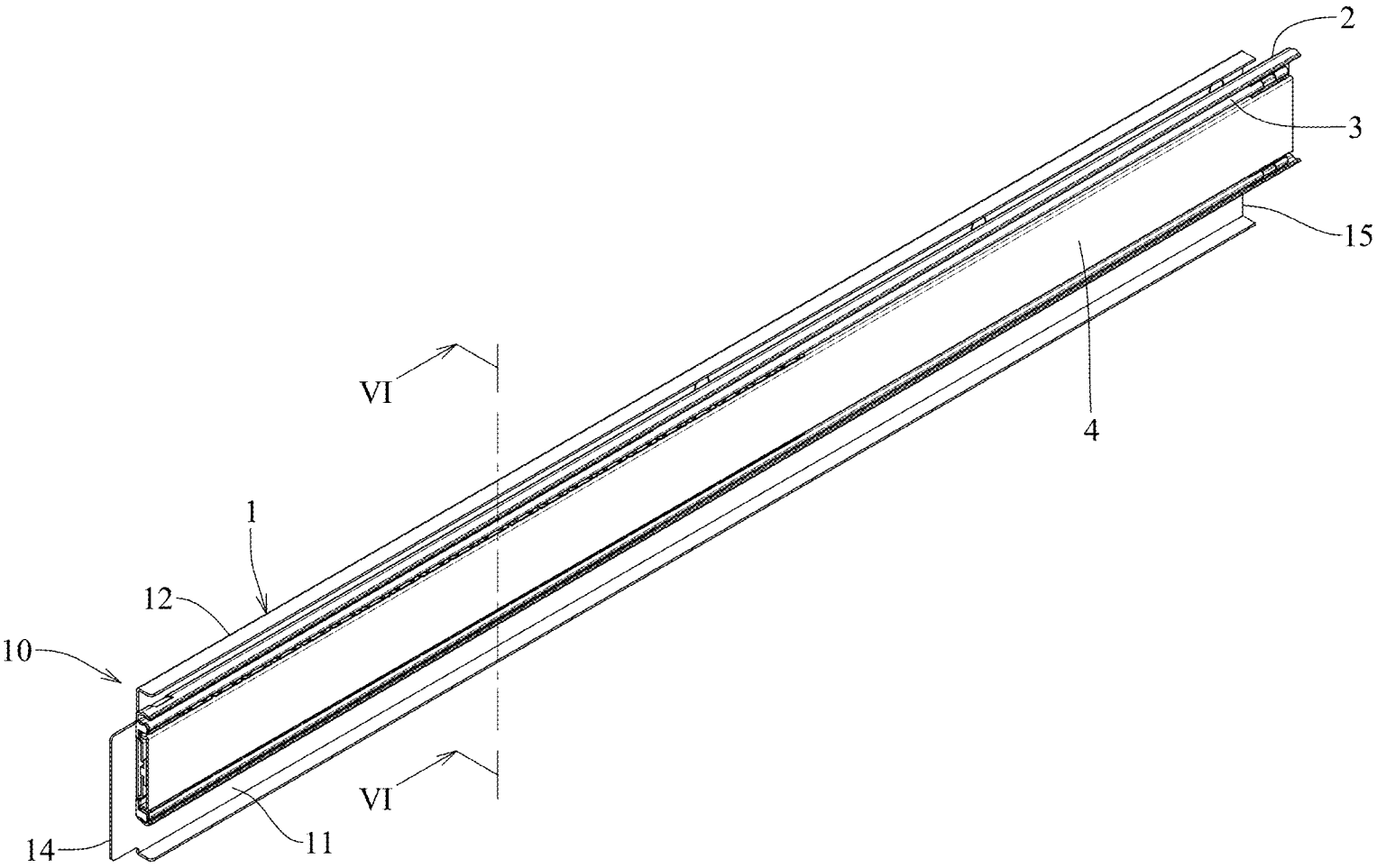
FIG. 1 is a perspective view illustrating an embodiment of a sliding rail device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
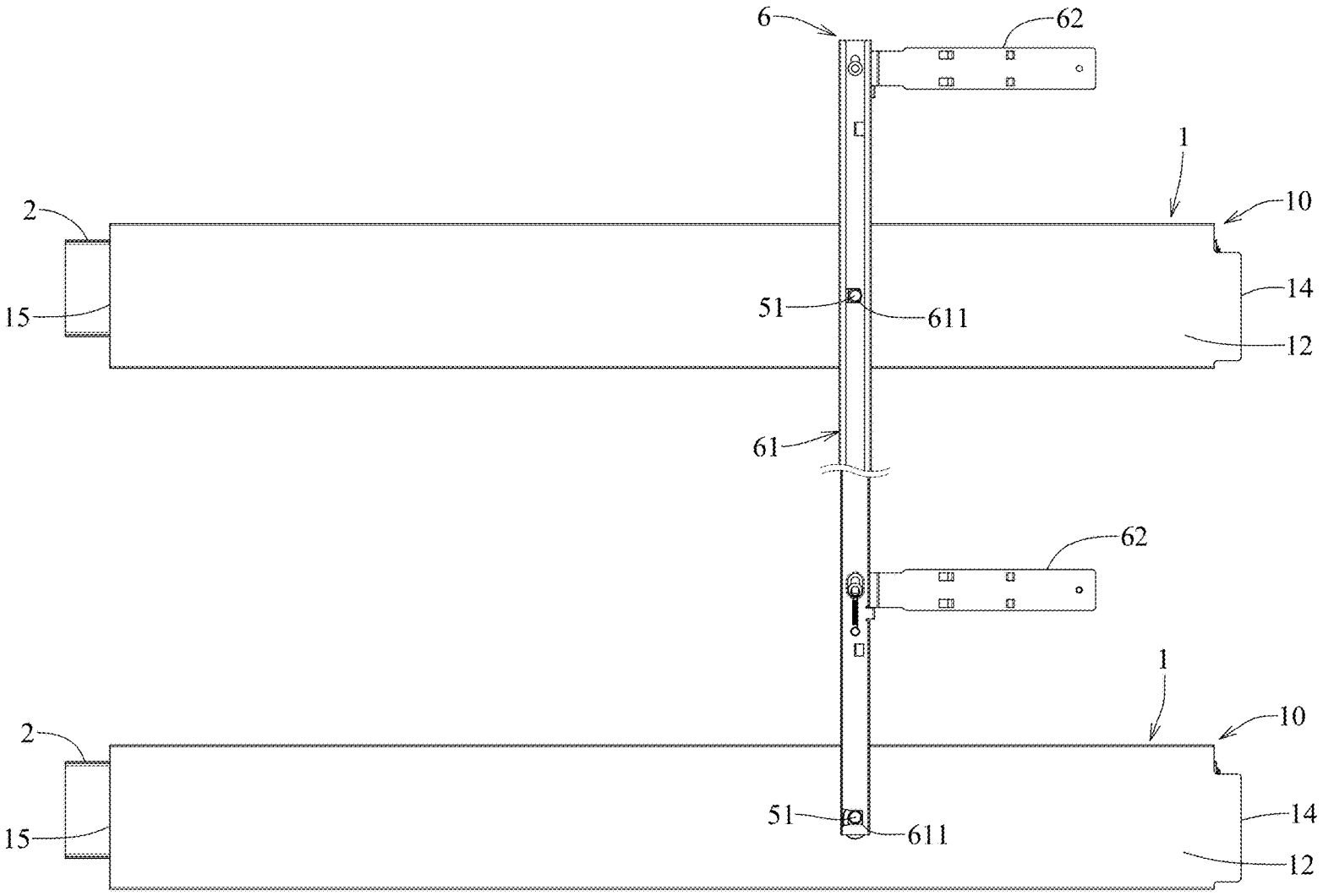
FIG. 2 is a fragmentary rear view illustrating two sliding rail devices of the disclosure being connected to a linking member.
Figure 3:
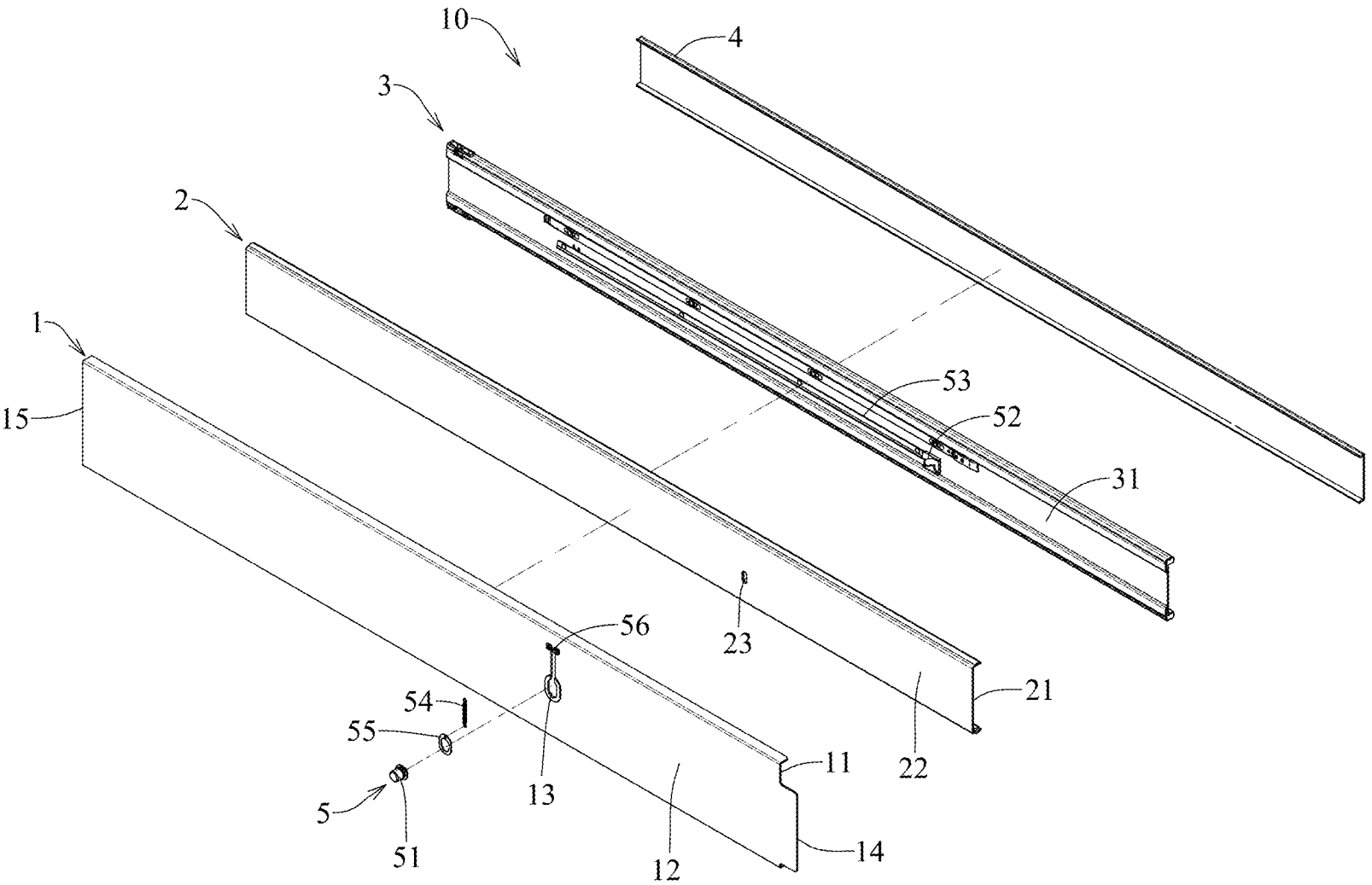
FIG. 3 is a partially exploded perspective view of the embodiment.
Figure 4:
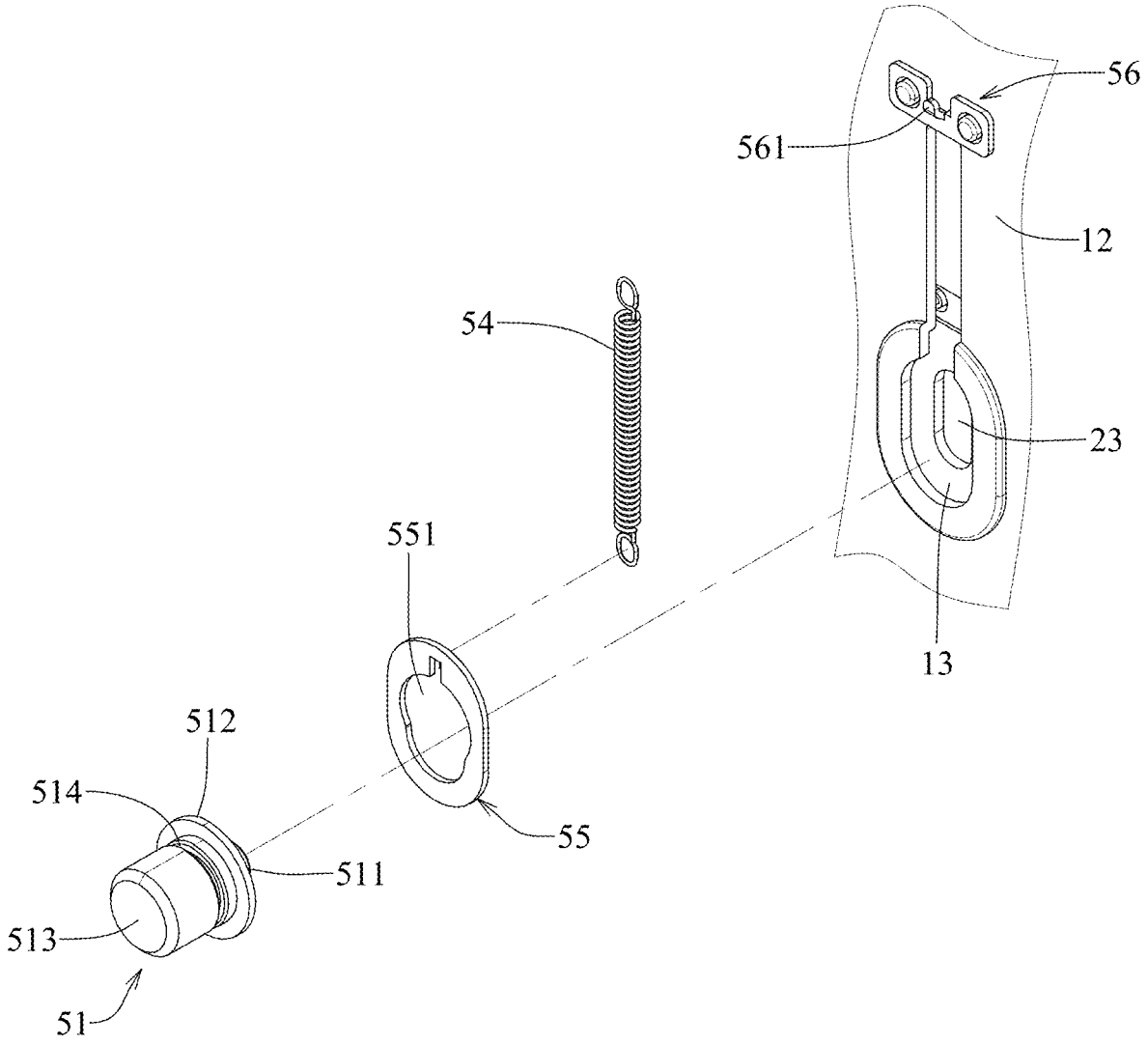
FIG. 4 is a fragmentary partially exploded perspective view of the embodiment, illustrating an exterior frame, an outer rail and a blocking mechanism.
Figure 5:
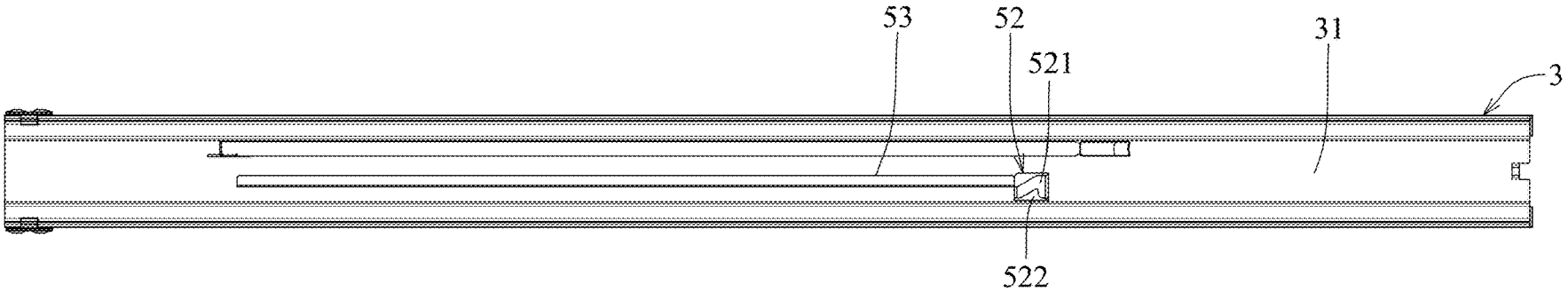
FIG. 5 is a fragmentary rear view of an intermediate rail and the blocking mechanism of the embodiment.
Figure 6:
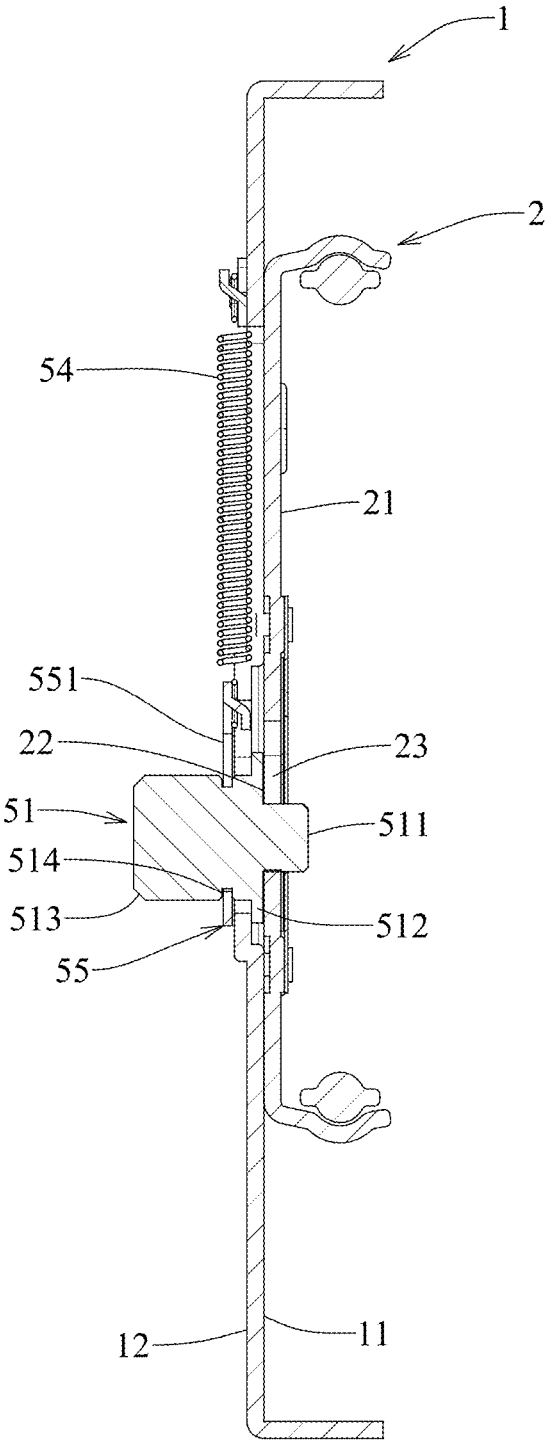
FIG. 6 is a fragmentary sectional view taken along line VI-VI in FIG. 1, and the intermediate rail and an inner rail are omitted.

Referring to FIGS. 1 to 3, an embodiment of a sliding rail device 10 according to the disclosure is adapted to be mounted to a server rack (not shown) and to be connected to a linking member 6. The linking member 6 has a linking rod 61 extending in an up-down direction, and two linking plates 62 extending in a longitudinal direction perpendicular to the up-down direction. Each of the linking plates 62 is connected to the linking rod 61, and is mounted to the server rack. The linking rod 61 has two linking holes 611. The sliding rail device 10 includes an exterior frame 1, an outer rail 2, an intermediate rail 3, an inner rail 4, and a blocking mechanism 5.

The exterior frame 1 is adapted to be fixed to the server rack, and has a frame surface 11, a fixing surface 12, an exterior groove 13, and first and second ends 14, 15. The first end 14 is opposite to the second end 15 in the longitudinal direction. The fixing surface 12 is opposite to the frame surface 11, extends between the first and second ends 14, 15, and is adapted to face the server rack. The exterior groove 13 extends through the frame surface 11 and the fixing surface 12. The outer rail 2 is disposed on the frame surface 11, and has a first outer rail surface 21, a second outer rail surface 22 opposite to the first outer rail surface 21 and facing the frame surface 11, a connecting groove 23 extending through the first outer rail surface 21 and the second outer rail surface 22, and corresponding in position to the exterior groove 13. The intermediate rail 3 is movably engaged with the outer rail 2, and has an intermediate rail surface 31 facing the outer rail 2. The inner rail 4 is movably engaged with the intermediate rail 3, and is adapted to be connected to a server chassis (not shown).

Referring to FIGS. 4 to 7, the blocking mechanism 5 has a positioning member 51 movably extending through the exterior groove 13 (see FIG. 3) and the connecting groove 23, and adapted to be fixed to the linking member 6 (see FIG. 2), a blocking member 52 disposed on the intermediate rail surface 31, a blocking strip 53 disposed on the intermediate rail surface 31, extending in the longitudinal direction, and abutting against the blocking member 52, a linking piece 55 sleeved on the positioning member 51, a resilient member 54 connected to the fixing surface 12 and the linking piece 55, and a fixing member 56 fixed to the fixing surface 12. The positioning member 51 has a positioning portion 511 movably extending through the exterior groove 13 and the connecting groove 23, an abutting portion 512 extending from the positioning portion 511 and abutting against the second outer rail surface 22, a joining portion 513 connected to the abutting portion 512 and adapted to be fixed to the linking member 6 via one of the linking holes 611, and a hooking groove 514 formed in the joining portion 513. The positioning portion 511 and the joining portion 513 are cylinders, and the abutting portion 512 is a circular plate. A diameter of the positioning portion 511 is smaller than a diameter of the joining portion 513, and the diameter of the joining portion 513 is smaller than a diameter of the abutting portion 512. The blocking member 52 has a blocking groove 521 and a blocking protrusion 522. The positioning member 51 is engaged with and movable along the blocking groove 521. The blocking groove 521 has a blocking portion 521*a* that extends in the up-down direction, and an inclined portion 521*b* that extends from an upper end of the blocking portion 521*a* toward the blocking strip 53, and that is downwardly inclined. The blocking protrusion 522 is disposed between the blocking portion 521*a* and the inclined portion 521*b*.

In this embodiment, the resilient member 54 is a spring. The linking piece 55 has a linking groove 551, and a lower hook 552 connected to a lower end of the resilient member 54 (see FIG. 8). The positioning member 51 extends through the linking groove 551. Specifically, the linking piece 55 is disposed on the fixing surface 12, is sleeved on the positioning member 51, and engages the hooking groove 514. The fixing member 56 has an upper hook 561 that is connected to an upper end of the resilient member 54.

Figure 7:
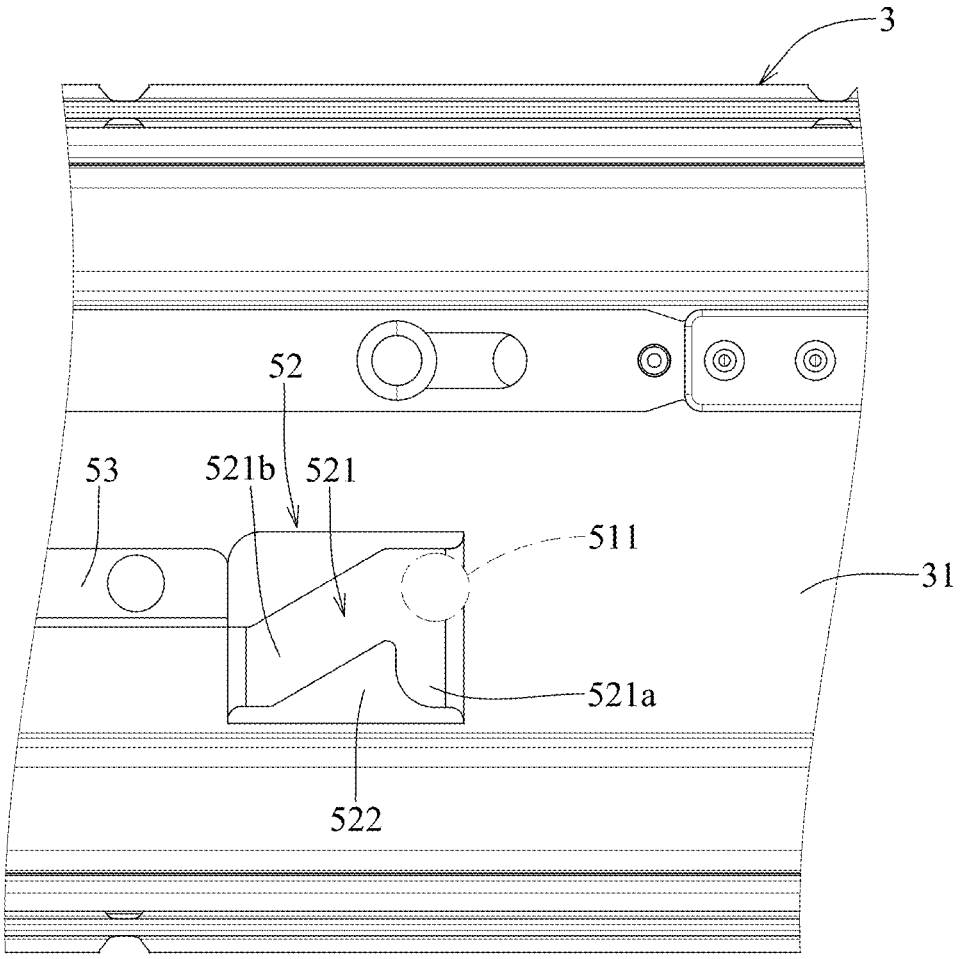
FIG. 7 is a fragmentary schematic rear view of the intermediate rail and the blocking mechanism, illustrating that a positioning portion of a positioning member of the blocking mechanism is at a starting position; that is, the positioning portion is positioned at a junction between an upper end of a blocking portion of a blocking groove and an upper end of an inclined portion of the blocking groove.
Figure 8:
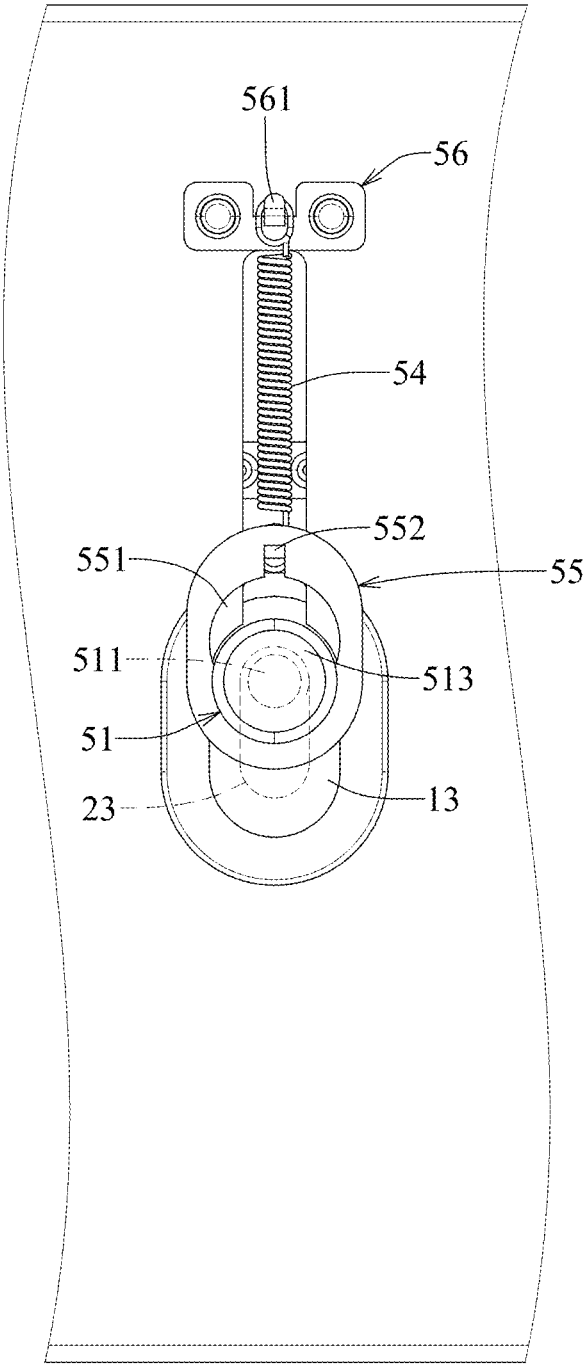
FIG. 8 is a fragmentary rear view of the exterior frame, illustrating that the positioning portion of the positioning member is at the starting position; that is, the positioning portion is positioned at an upper end of a connecting groove.
Figure 9:
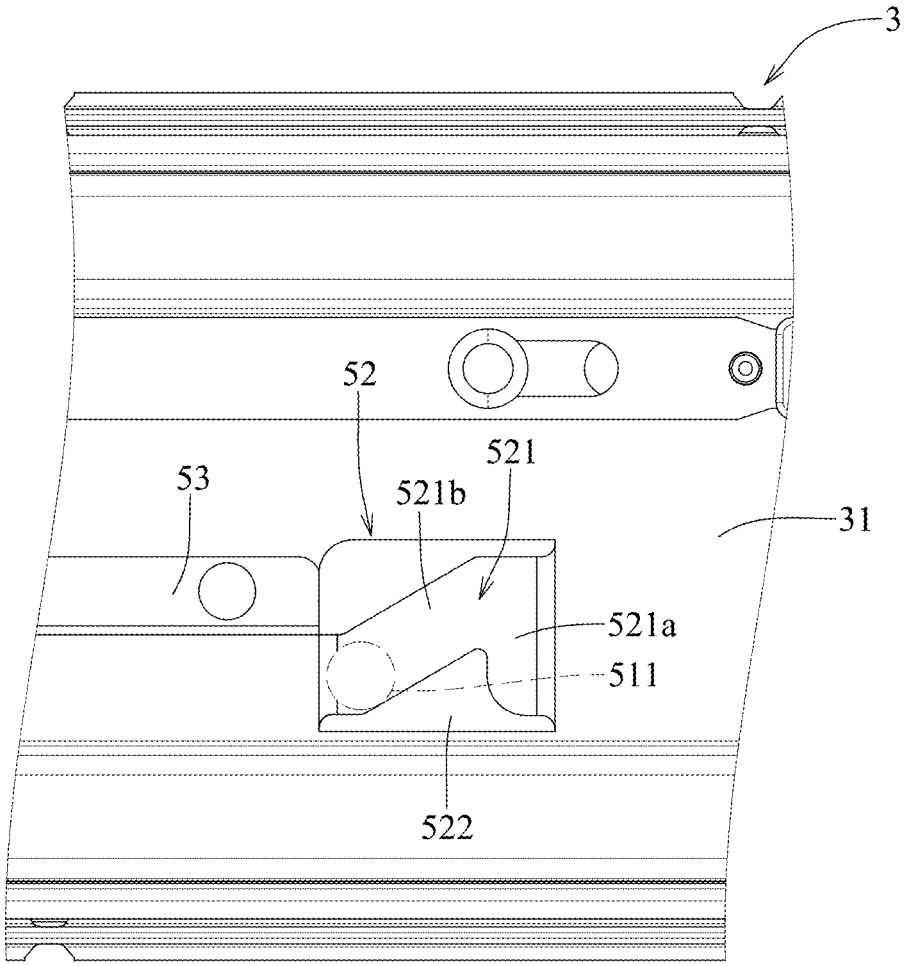
FIG. 9 is a fragmentary schematic rear view of the intermediate rail and the blocking mechanism, illustrating the positioning portion of the positioning member being positioned at a lower end of the inclined portion of the blocking groove.
Figure 10:
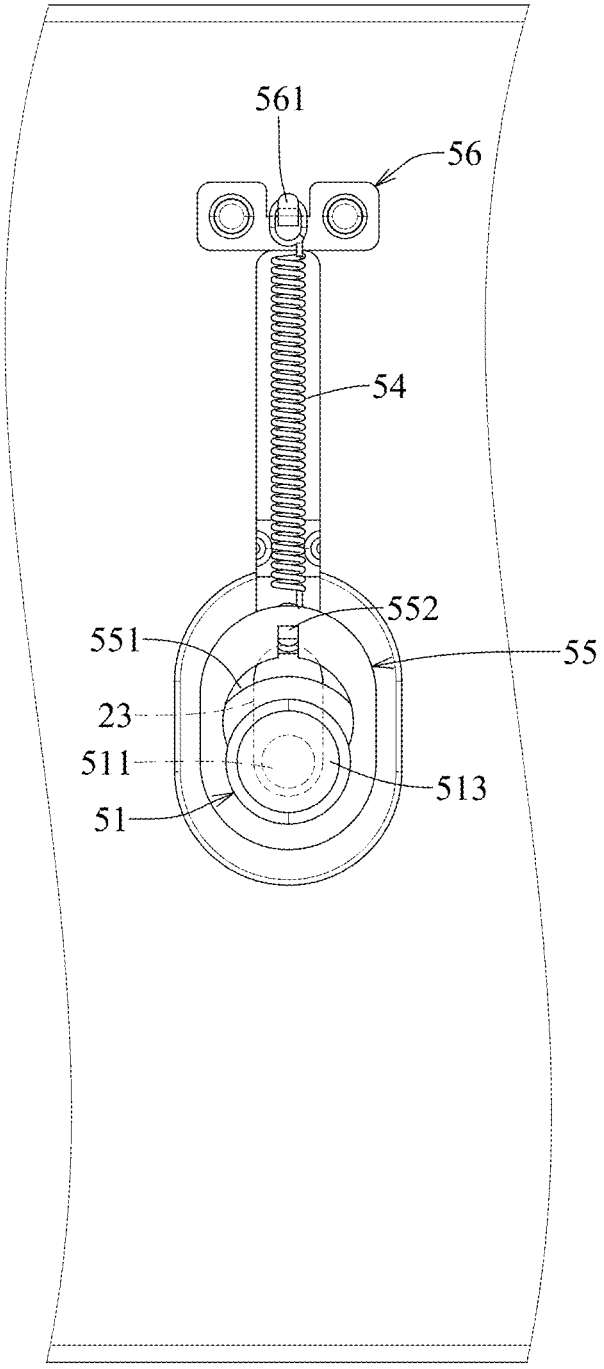
FIG. 10 is a fragmentary rear view of the exterior frame and the blocking mechanism, illustrating the positioning portion of the positioning member at a lower end of the connecting groove.
Figure 11:
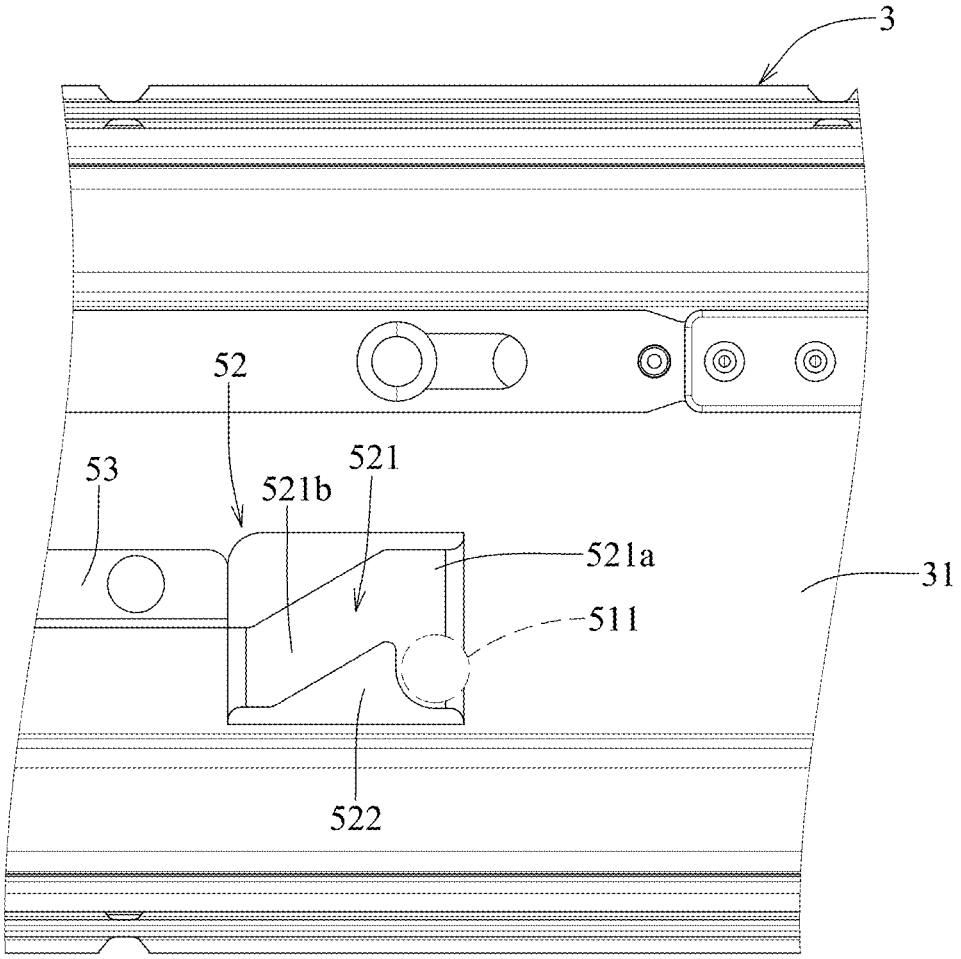
FIG. 11 is a fragmentary schematic rear view of an intermediate rail of another sliding rail device, illustrating a positioning portion of a positioning member of the another sliding rail device being adjacent to a blocking protrusion thereof.

Referring to FIGS. 7 and 8, when the positioning portion 511 is at a starting position, the positioning portion 511 is disposed at a junction between an upper end of the blocking portion 521*a* of the blocking groove 521 and an upper end of the inclined portion 521*b* of the blocking groove 521 (see FIG. 7), and is also disposed at a top end of the connecting groove 23 (see FIG. 8). When the server chassis is pulled out from the server rack, the intermediate rail 3 is moved in the longitudinal direction relative to the outer rail 2, the positioning portion 511 of the positioning member 51 is pushed by the blocking member 52 to move downwardly along the inclined portion 521*b* to a lower end of the inclined portion 521*b* (see FIG. 9) against a resilient force of the resilient member 54, and at the same time, the positioning portion 511 moves downwardly to a lower end of the connecting groove 23 (see FIG. 10). Since the joining portion 513 is fixed to the linking member 6, the positioning member 51 is consequently adapted to move the linking member 6 downwardly and adapted to drive another sliding rail device 10 (see FIG. 2) that is connected to the linking member 6 and that is identical to the sliding rail device 10 to move synchronously in a manner where the positioning member 51 of the another sliding rail device 10 is moved downwardly along the blocking portion 521*a* of the another sliding rail device 10 to be adjacent to the blocking protrusion 522 of the another sliding rail device 10 (see FIG. 11), so as to prevent movement of the intermediate rail 3 of the another sliding rail device 10 relative to the outer rail 2 of the another sliding rail device 10, thereby preventing the another sliding rail device 10 from unexpectedly moving outwards. When the intermediate rail 3 moves in the longitudinal direction relative to the outer rail 2, the blocking strip 53 blocks the positioning portion 511 from moving upwardly (i.e., the positioning portion 511 stays below the blocking strip 53), ensuring that the linking member 6 does not move upwardly, and that the blocking protrusion 522 of the another sliding rail device 10 is blocked by the positioning portion 511 of the another sliding rail device 10, so that the intermediate rail 3 of the another sliding rail device 10 will not move relative to the outer rail 2 of the another sliding rail device 10. When the server chassis is pushed back into the server rack, the intermediate rail 3 is moved in a direction opposite to the longitudinal direction relative to the outer rail 2, the positioning member 51 is driven by the resilient force of the resilient member 54, via the linking piece 55, to move upwardly along the inclined portion 521*b*, and the positioning portion 511 of the positioning member 51 is moved upwards towards the starting position, which drives the linking member 6 to move upwardly, and consequentially moves the positioning portion 511 of the another sliding rail device 10 towards the starting position, so that the positioning portion 511 of the another sliding rail device 10 no longer blocks the blocking protrusion 522 of the another sliding rail device 10. Hence, the another sliding rail device 10 will not move outwardly during use of the sliding rail device 10.

In conclusion, when the intermediate rail 3 is moved in the longitudinal direction relative to the outer rail 2, the positioning member 51 is pushed by the blocking member 52 to move downwardly along the inclined portion 521*b*, and is consequently adapted to move the linking member 6 downwardly and is adapted to drive another sliding rail device 10 that is connected to the linking member 6 and that is identical to the sliding rail device 10 to move synchronously in a manner where the positioning member 51 of the another sliding rail device 10 is moved downwardly along the blocking portion 521*a* of the another sliding rail device 10 to be adjacent to the blocking protrusion 522 of the another sliding rail device 10 so as to prevent movement of the intermediate rail 3 of the another sliding rail device 10 relative to the outer rail 2 of the another sliding rail device 10. Hence, the another sliding rail device 10 will not move outwardly during use of the sliding rail device 10, and an objective of the disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, the one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A sliding rail device adapted to be mounted to a server rack and connected to a linking member, said sliding rail device comprising:

an exterior frame that is adapted to be fixed to the server rack, and that has first and second ends, said first end being opposite to said second end in a longitudinal direction;

a frame surface, a fixing surface opposite to said frame surface, extending between said first and second ends, and adapted to face the server rack, and an exterior groove extending through said frame surface and said fixing surface;

an outer rail that is disposed on said frame surface, and that has a first outer rail surface, a second outer rail surface opposite to said first outer rail surface and facing said frame surface, and a connecting groove extending through said first outer rail surface and said second outer rail surface, and corresponding in position to said exterior groove;

an intermediate rail that is movably engaged with said outer rail, and that has an intermediate rail surface facing said outer rail; and a blocking mechanism that has a positioning member movably extending through said exterior groove and said connecting groove, and adapted to be fixed to the linking member, a blocking member disposed on said intermediate rail surface, and having a blocking groove and a blocking protrusion, a blocking strip disposed on said intermediate rail surface, extending in the longitudinal direction, and abutting against said blocking member, a linking piece sleeved on said positioning member, and a resilient member connected to said fixing surface and said linking piece;

wherein said blocking groove has a blocking portion that extends in an up-down direction perpendicular to the longitudinal direction, and an inclined portion that extends from an upper end of said blocking portion towards said blocking strip, and that is downwardly inclined, said blocking protrusion being disposed between said blocking portion and said inclined portion, said positioning member being engaged with and movable along said blocking groove;

wherein, when said intermediate rail is moved in the longitudinal direction relative to said outer rail, said positioning member is pushed by said blocking member to move downwardly along said inclined portion against a resilient force of said resilient member, and is consequently adapted to move the linking member downwardly and adapted to drive another sliding rail device that is connected to the linking member and that is identical to said sliding rail device to move synchronously in a manner where a positioning member of the another sliding rail device is moved downwardly along a blocking portion of the another sliding rail device to be adjacent to a blocking protrusion of the another sliding rail device, so as to prevent movement of an intermediate rail of the another sliding rail device relative to an outer rail of the another sliding rail device; and wherein, when said intermediate rail is moved in a direction opposite to the longitudinal direction relative to said outer rail, said positioning member is driven by the resilient force of said resilient member, via said linking piece, to move upwardly along said inclined portion.

2. The sliding rail device as claimed in claim 1, wherein said positioning member has a positioning portion movably extending through said exterior groove and said connecting groove, an abutting portion extending from said positioning portion and abutting against said second outer rail surface, and a joining portion connected to said abutting portion and adapted to be fixed to the linking member.

3. The sliding rail device as claimed in claim 2, wherein said positioning portion and said joining portion are cylinders, said abutting portion being a circular plate.

4. The sliding rail device as claimed in claim 2, wherein said positioning member further has a hooking groove that is formed in said joining portion, said linking piece engaging said hooking groove and being disposed on said fixing surface.

5. The sliding rail device as claimed in claim 2, wherein said blocking mechanism further has a fixing member fixed to said fixing surface and having an upper hook that is connected to an upper end of said resilient member.

6. The sliding rail device as claimed in claim 5, wherein said linking piece has a linking groove, and a lower hook connected to a lower end of said resilient member, said positioning member extending through said linking groove.

* * * * *